US005979644A

United States Patent [19]

Wong

[11] Patent Number: 5,979,644

[45] Date of Patent: Nov. 9, 1999

[54] MULTI-CELL CARRIER CONSTRUCTION

[75] Inventor: Wilbur Wong, Richmond, Calif.

[73] Assignee: Union Camp Corporation, Prinecton, N.J.

[21] Appl. No.: 09/052,621

[22] Filed: Mar. 31, 1998

[51] Int. Cl.[6] ..... B65D 75/00

[52] U.S. Cl. ..... 206/172; 206/175; 206/198

[58] Field of Search ..... 206/170, 171, 206/172, 173, 174, 175, 180, 183, 184, 188, 193, 198

[56] References Cited

U.S. PATENT DOCUMENTS

| | | | |
|---|---|---|---|
| 3,119,515 | 1/1964 | Kursh | 206/198 |
| 3,752,356 | 8/1973 | Forrer | 206/198 |
| 4,406,365 | 9/1983 | Kulig | 206/198 |

*Primary Examiner*—Jacob K. Ackun

*Attorney, Agent, or Firm*—Watov & Kipnes, P.C.

[57] ABSTRACT

A multi-unit foldable carrier including a pair of opposed side walls, a pair of opposed end walls and a bottom wall, formed from two panels, adjacent to the side and end walls to form an open, generally rectangular container. A handle allows the carrier to be lifted and is formed from at least two panels extending upwardly from the bottom wall and also acting to divide the generally rectangular container into at least two sections. A divider construction is coupled to at least one of the side walls or one of the end walls for further dividing the rectangular container into more than two separate volumes. Each of the side walls, end walls, bottom wall panels, handle means and divider means is formed as sections of a single sheet of laminar stock demarcated by scored lines adapted to allow the sheet to be folded along the creased lines to form each of the sections. A multi-unit foldable carrier which is capable of receiving more than two items in the more than two volumes of the container is provided.

10 Claims, 6 Drawing Sheets

MULTI-CELL CARRIER CONSTRUCTION

BACKGROUND OF THE INVENTION

The invention is generally directed to a multi-cell carrier construction and in particular to a multi-cell carrier construction designed to carry a plurality of bottles, containers or other solid objects of generally similar size and shape. In addition the invention is directed to a multi-cell carrier constructions which may be quickly and conveniently assembled from a single sheet of laminar material such as corrugated cardboard, corrugated plastic or similar materials.

Liquor stores, grocery stores and other stores which sell bottles of wine, beer and other types of stores which sell loose items of various sorts have the need for open topped multi-celled carriers which allow a customer to circulate throughout the store, selecting merchandise as they move through the aisles and placing selections in a carrier to ease the ability to collect and transport the items prior to purchase. Similarly, the carriers are often designed to implement a policy at the stores where a customer receives a special discount in the event that they purchase more than a minimum number of units of varying types. For example, many liquor and grocery stores provide discounts of 10% or more to customers who purchase six bottles of wine. Wine is traditionally sold in cases of 12 bottles and when a customer purchases a case of a particular type the store staff aids the customer in moving the case. However, there is a growing market for consumers who do not purchase wine by the case and thus purchase only one or several bottles of wine at a time. Rarely do they purchase a case of any single type of wine. Thus, as a promotional element the stores have gone to promotions which induce the customer to purchase six bottles of wine which may be mixed and matched and thus receive a discount regardless of the brands or types of wines included in the selection.

To promote this activity the liquor stores and grocery stores have sought out carriers which may be used by the customers in place of shopping wagons or traditional baskets. The shopping wagons and traditional open baskets with handles are ill suited to wine bottles which can break if they jiggle and fall against each other. Likewise, a customer is generally unable to carry more than two or three bottles of wine without severe discomfort or danger of dropping and breaking a bottle of wine. Accordingly, stores of this sort have sought carrier constructions, generally made from corrugated paper, cardboard or similar sheet like or laminate materials with integral handle that allows a customer to carry two, four, six or eight bottles of wine or spirits in such a way that the bottles will not fall, do not bang against each other and include a handle which allows relatively easy transporting of the bottles around the store and to the cash register. The carrier may then either be returned or reused by the store or may be provided to the customer to aid them in transport in the purchases to their car and home.

Previous attempts at this type of carrier include light cardboard constructions manufactured for carrying six packs of beer. Generally, these constructions are relatively flimsy and are also constructed from a variety of different panels of thin cardboard which are glued together to form the carrier. These carriers, once constructed, are not conveniently shipped or useful for consumer loading or unloading. Often, they are damaged when they are unloaded and tend to acquire their stability from the presence of the full complement of bottles within the carrier. Thus, if only two or three bottles remain in the carrier it becomes unstable and has a tendency to rip or buckle.

Other attempts have been made to manufacture multi-cell carriers with a single sheet of cardboard which is glued together at various points and which is scored and cut in accordance with a pattern to provide a finished three-dimensional multi-cell carrier construction. However, these prior art constructions have utilized substantial amounts of sheet material and are particularly complicated and difficult to assemble in the field.

Two major problems that exist in this area are the ease with which the finished product may be assembled from a generally flattened shipping state to a fully assembled three dimensional carrier configuration and the amount of sheet material utilized to accomplish the result with a generous excess of strength for the construction.

The prior art constructions manufactured from a single sheet of material are generally complex configurations requiring a substantial level of skill to assemble as well as a particularly strong, thick and therefore expensive grade and quantity of sheet material. Because these constructions require such substantial amounts of sheet material and numerous creases, cuts and similar design and manufacturing steps prior to delivery they raise the cost for these products, increase the tare weight and thus reduce the utility and minimize the market for these products.

Accordingly, there is a need for an improved multi-cell carrier construction which may be shipped flat, assembled quickly and simply and which retains the required strength characteristics with a reduced amount of material including thinner wall constructions and fewer assembly steps.

SUMMARY OF THE INVENTION

The invention is generally directed to a multi- unit foldable carrier including a pair of opposed sidewalls, a pair of opposed end walls located between the ends of the sidewalls to form a generally rectangular tube, bottom wall, formed from two panels, adjacent to the side and end walls to form an open, generally rectangular container, a handle construction for allowing the carrier to be lifted, formed from at least two panels extending upwardly from the bottom wall and also acting to divide the generally rectangular container into at least two sections and a divider construction coupled to at least one of the end walls for further dividing the rectangular container into more than two separate volumes, each of the side walls, end walls, bottom wall panels, handle construction and divider construction being formed as sections of a single sheet of laminar stock demarcated by creased lines adapted to allow the sheet to be folded along the creased lines to form each of the sections, whereby a multi-unit foldable carrier adapted to receive more than two items in the more than two volumes is provided.

It is another goal of the invention to provide an improved multi unit foldable carrier which may be rapidly and simply assembled from a pre-cut pre-formed single sheet of laminar stock.

A further goal of the invention is to provide an improved multi-unit foldable carrier formed from a single sheet of laminar stock which is cut and prescored to allow folding along the prescored lines, which may be assembled by simple folding into a sturdy multi-unit foldable carrier.

Yet a further goal of the invention is to provide an improved multi-unit foldable carrier which may be shipped in a flat orientation and then assembled into a three dimensional carrier state without the need for any assembly.

Still a further goal of the invention is to provide an improved multi-unit foldable carrier in which the carrier is formed from a single sheet of laminar stock and the handle is integrally formed in a central orientation to act as a means for dividing the interior volume of the carrier into at least two sections.

Yet still another goal of the invention is to provide an improved multi unit foldable carrier in which the base and handle of the carrier are integrally formed so that upward pressure on the handle acts to maintain the base of the carrier in place with items stored therein.

Yet still another goal of the invention is to provided an improved multi-unit foldable carrier construction which may be die cut or otherwise cut and prescored from a single sheet of material, shipped in a relatively flat orientation and then easily assembled without the need for tools or complex instructions.

Still yet a further goal of the invention is to provided an improved multi unit foldable carrier which allows a carrier container with partially prefolded partitions and an integral handle to be shipped for assembly.

Still yet a further goal of the invention is to provided an improved multi unit foldable carrier in which assembly is easily accomplished and various cell configurations may be implemented without substantial modifications in the construction.

Yet still another goal of the invention is to provided an improved open top box with a carry handle to encourage the purchase of multiple bottles of wine which has a simplified and rapid assembly process.

Still other objects and advantages of the invention will in part be obvious and will in part be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
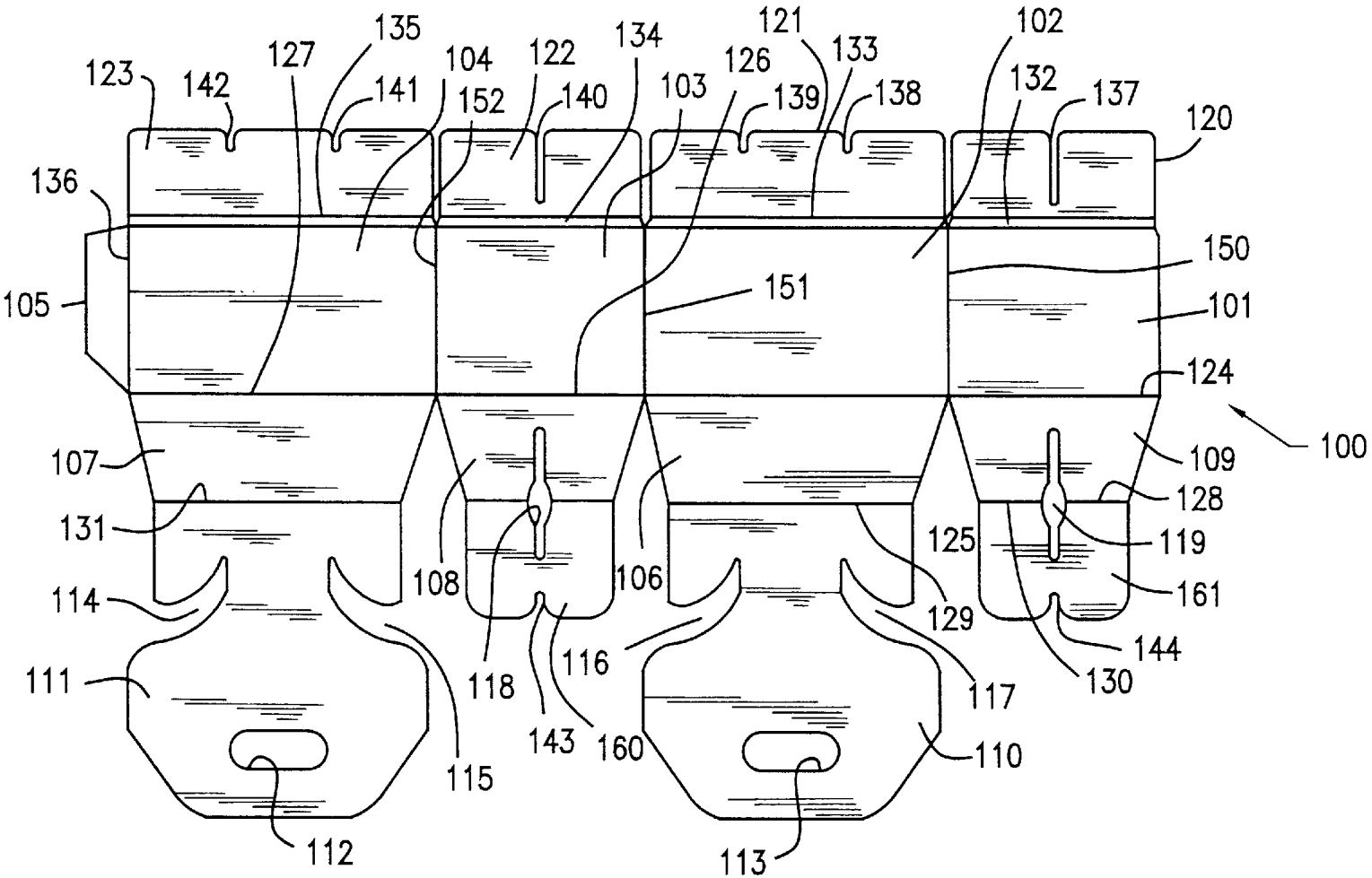
FIG. 1 is a top elevational view of a cut out sheet for a multi cell carrier construction in accordance with a first preferred embodiment of the invention.

Reference is first made to FIG. 1 wherein a sheet, generally indicated as 100 constructed in accordance with a preferred embodiment of the invention is depicted. Generally, the sheet is die cut or similarly severed from a larger sheet of the laminar stock, such as cardboard, corrugated cardboard or corrugated plastic or similar materials in one cutting operation. In addition, the various lines shown on the sheet 100 such as 150, 151 and 152 are prescored lines which enable the sheet material to fold cleanly along these prescored lines and, along with the cuts define the different sections of the final carrier construction. Construction 100 includes end wall panels 101, 103, sidewall panels 102, 104 and overlap wall panel 105 which is permanently affixed to the free end of end panel 101 to form a tube construction including side and end wall panels 101–104. Bottom side panels 106 and 107 and bottom end panels 108, 109 are connected across scored lines 124, 125, 126 and 127 to side and end inside wall panels 101–104. In turn, handle panels 110, 111 and integral divider panels 160, 161 are secured to bottom side and end panels 106–109 along prescored lines 128, 131. Handle sections 110, 111 include cutout handle openings 113, 112 respectively and curved receiving slots 114–117. Similarly, slots 118 and 119 extend through base end panel and integral divider elements 108, 160 and 109, 161 respectively. Horizontal flaps 121 and 123 and end flaps 120 and 122 are coupled to horizontal side and end walls 101–104 through prescored fold lines 132–135. In addition, end and side flaps 120–123 have notches 137–142.

Figure 2:
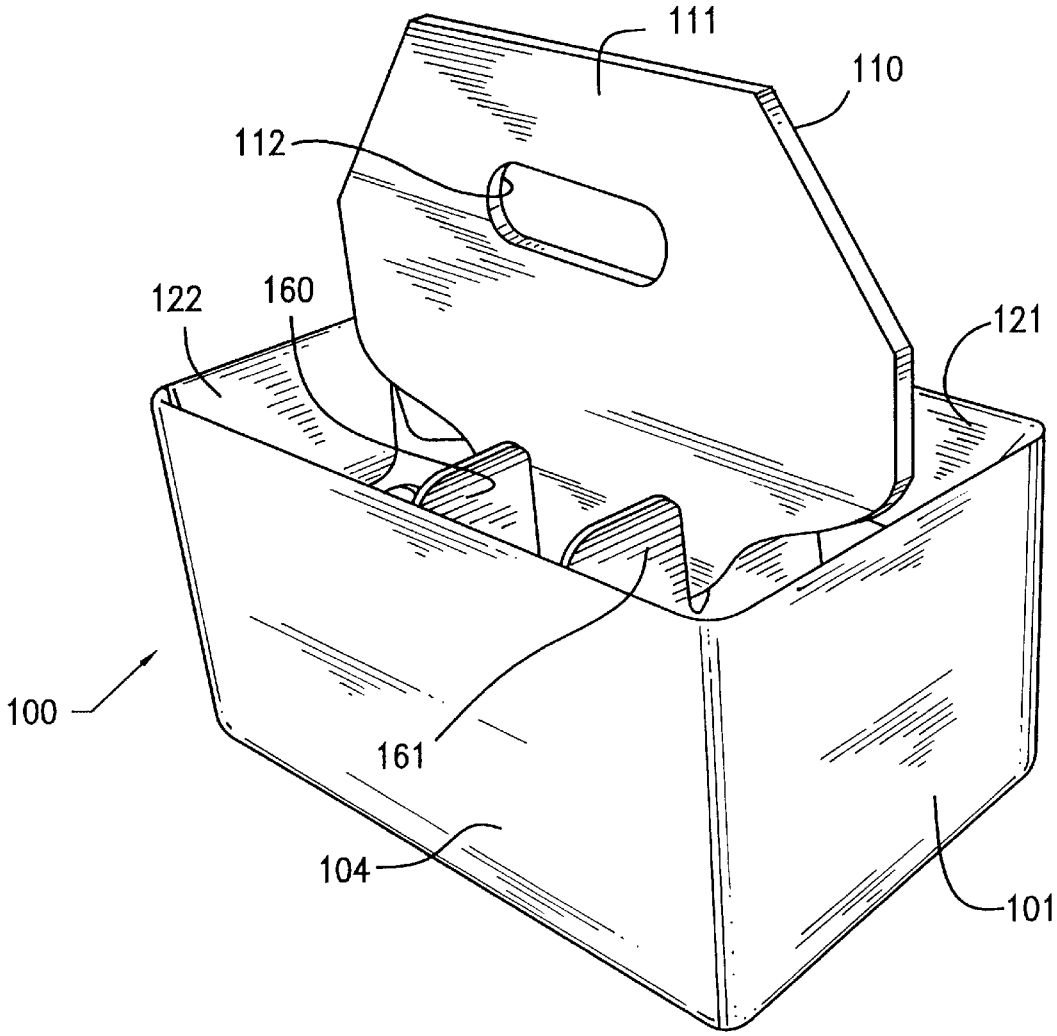
FIG. 2 is a perspective view of the assembled carrier construction of FIG. 1.
Figure 3:
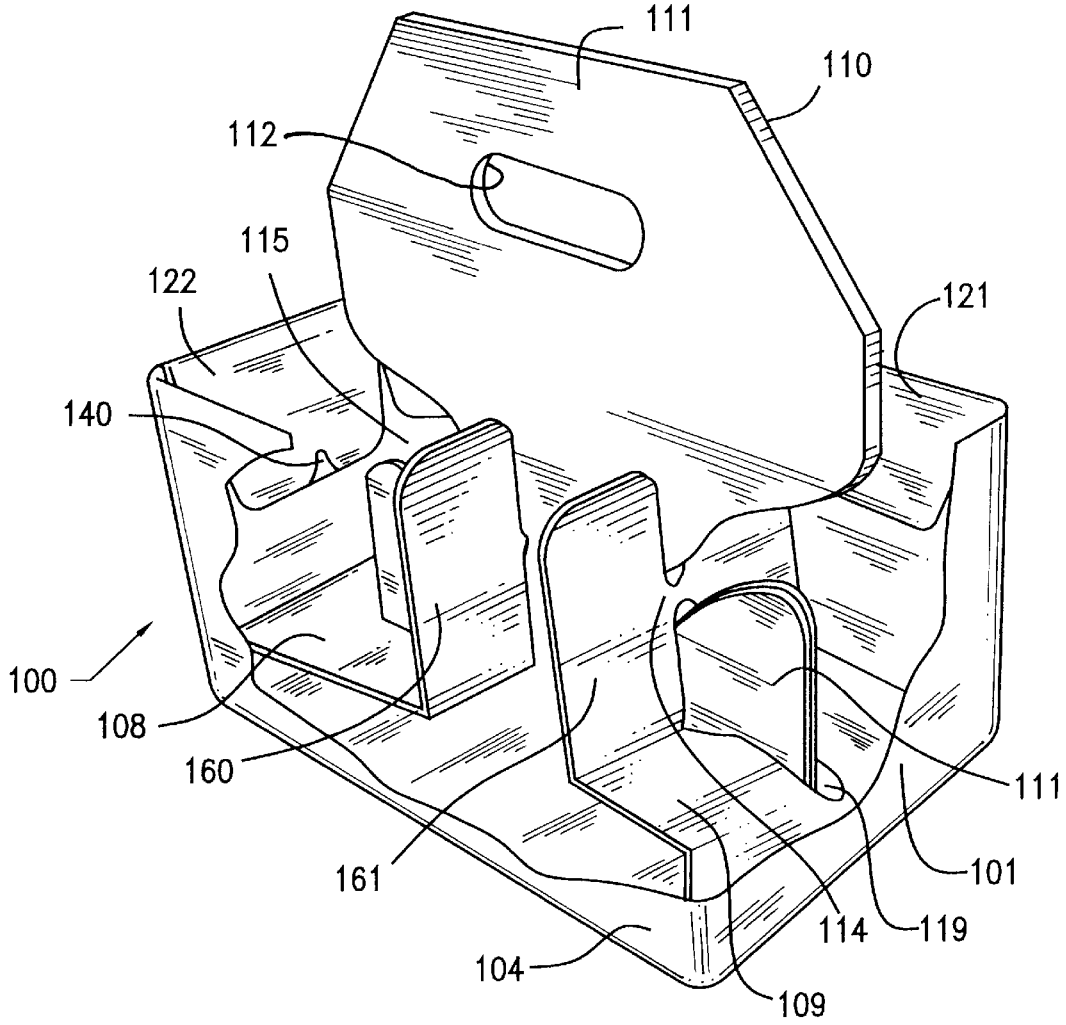
FIG. 3 is a partially cut away perspective view, similar to the view of FIG. 2 of the carrier construction of FIG. 2 in which the interior divider elements and surfaces are shown.

Reference is next made to FIGS. 2 and 3 wherein the multi unit carrier is shown in an assembled form. In FIG. 3 the outer walls of carrier 100 are shown cutaway to show the interior dividers.

Following the attachments of flap 105 to end wall 101 by gluing or other attachment in accordance with commonly used conventional construction techniques, handle sections 110, 111 and bottom side panels 106, 107 are folded along lines 125, 127 with handle portions 110, 111 extending outward beyond side panels 121, 123 and divider panels 160, 161 and bottom end panels 108, 109 rotated about fold lines 124, 126 toward end panels 120, 122. In this condition the carrier 100 can be shipped in a flattened form with folds along fold lines 150 and 152. Handle portion 110, 111 extend upwardly beyond side and end panels 120, 121, 122, and 123. Alternatively, handle portions 110, 111 and divider panels 160, 161 may be rotated about folding lines 129, 131, 130 and 128, respectively, toward side end panels 120–123. Thereafter, the carrier is squared so that side and end walls 101–104 form a rectangular tube. Handles 110, 111 are pressed downward and together so that bottom side panels 106, 107 form most of the base of carrier 100. Then bottomend panels 108 and 109, and divider panels 160 and 161 are pressed downwardly and inwardly so that slots 118 and 119 slide into receiving slots 114, 117 and 116, 115 as shown in FIG. 3. This places bottom end panels 108, 109 flat against bottom side panels 106, 107 with divider panels 160, 161 being vertically oriented thereby defining three separate volumetric spaces from end wall 101 to end wall 103 on each side of handle panels 110, 111. Thus, there are six spaces created which, depending upon the arrangement of the panel lengths and dimensions can be made generally equal or unequal in size. In the current preferred embodiment the sizes are generally equal. The divider panels 160, 161 are generally locked in place in slots 114–117. Finally, side panels 121 and 123 are rotated downwardly into the interior of the box. Fold lines 135, 133 are created as two separate scores which provide a clean rounded upper surface. Notches 138, 139 and 141–142 rotate down and allow the side panel to rotate past the upper portion of divider panels 160, 161 at each side. Similarly end panels 120 and 122 also rotate downwardly locking the side panels 121 and 123 in place. End panels 120, 122 have slots 137 and 140 which allow the end panels to rotate past the outer edges of handle sections 110, 111.

Figure 4:
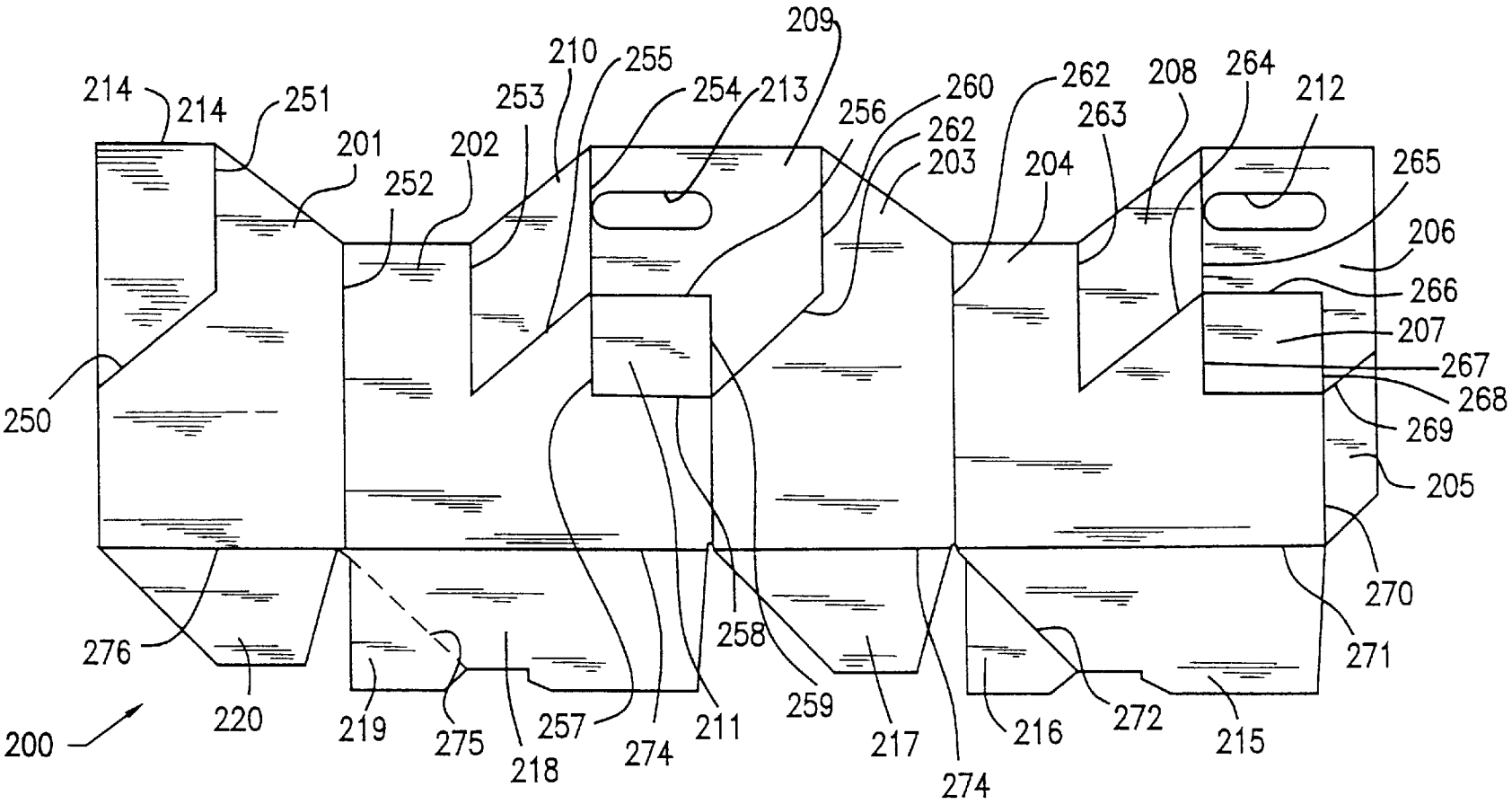
FIG. 4 is a top elevational view of sheet of laminar stock for forming a multi-celled carrier construction in accordance with another preferred embodiment of the invention.
Figure 5:
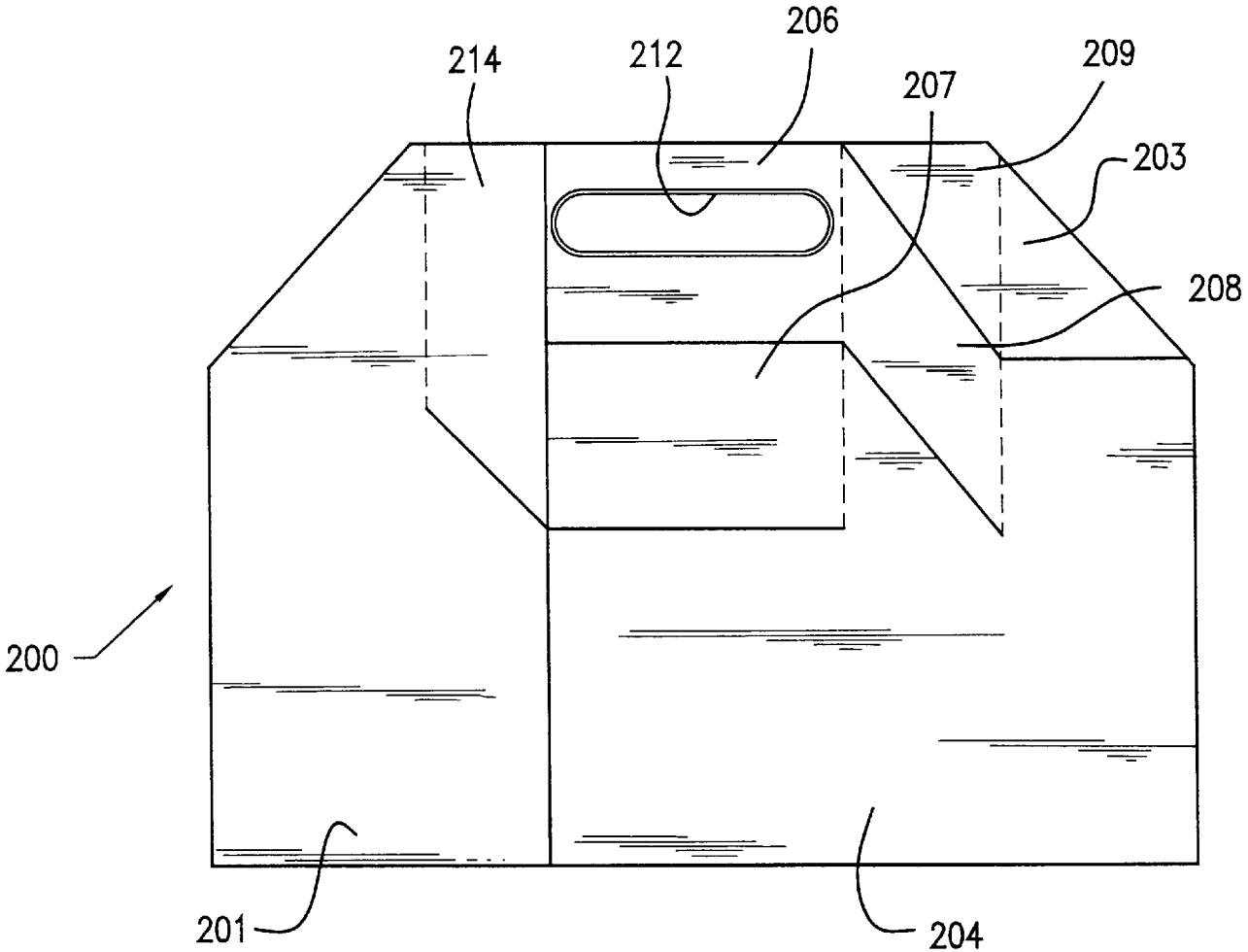
FIG. 5 is a top elevational view of the carrier construction of FIG. 4 in its generally flat shipped condition.
Figure 6:
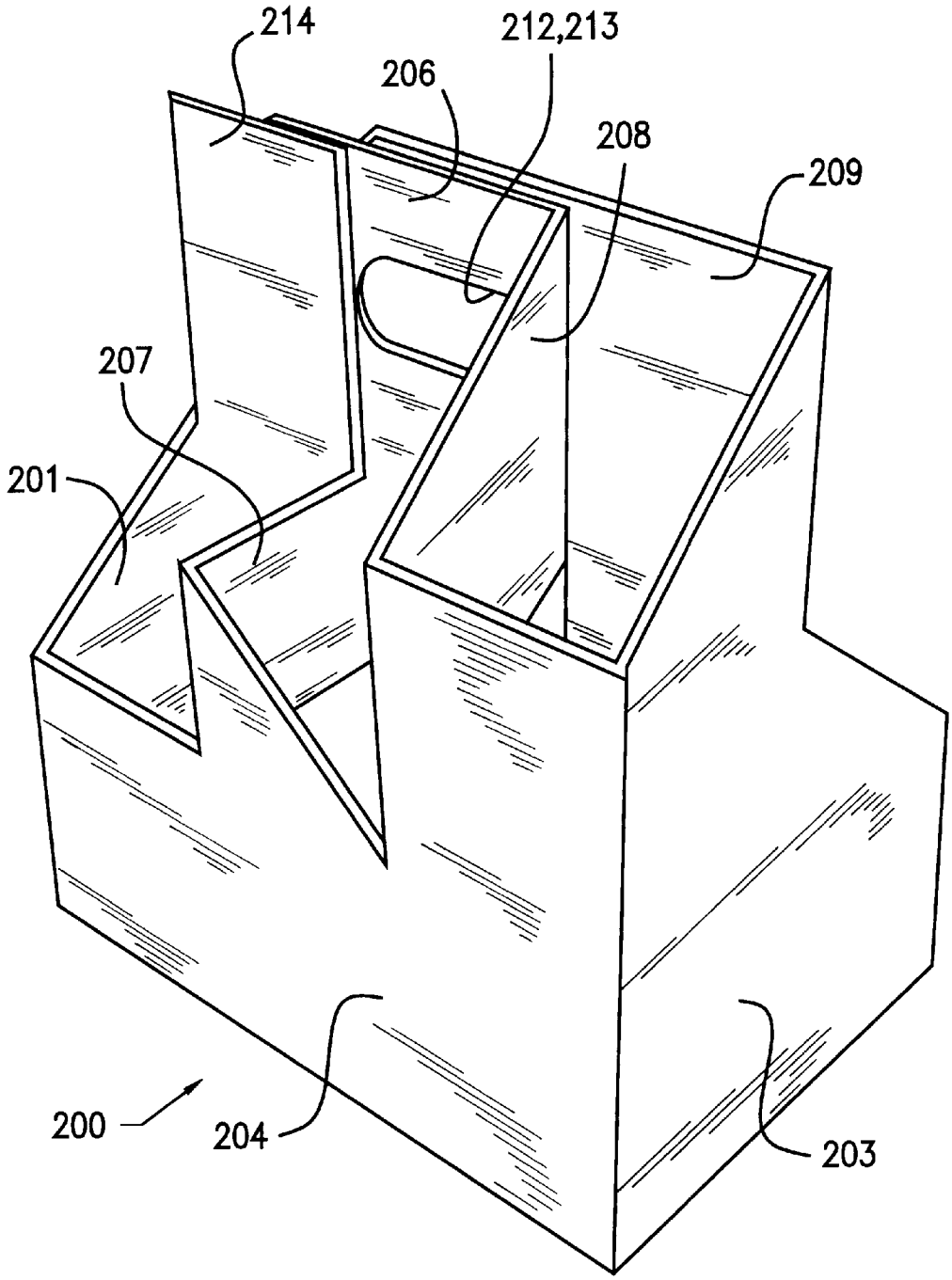
FIG. 6 is a perspective view of an assembled multi-celled carrier construction in accordance with the embodiment of FIGS. 4 and 5.

Reference is next made to FIGS. 4, 5 and 6 wherein a multi-cell carrier construction in accordance with another preferred embodiment of the invention is depicted. The multi-celled carrier construction is generally indicated as 200. FIG. 4 shows the carrier as a single sheet with fold score and perforation lines marked and is a view of the inside of the finished carrier 200. FIG. 5 shows the construction 200 in its assembled, flattened form. FIG. 6 shows the carrier 200 in its fully assembled and open position. In contrast to the embodiment of FIGS. 1–3, the carrier 200 of FIGS. 4–6 is completely assembled in the manufacturing operation and requires only gentle pressure on the opposed corners of FIG. 5 to cause the carrier to open completely and lock in the open position shown in FIG. 6.

Carrier 200 includes main side and end panels 201, 202, 203 and 204. A end tab or flap 205, which is designed to be secured to panel 201, is secured at the end of panel 204. In addition, there are handle panel 206, divider portions 207, 208, handle portion 209, divider portions 210, 211, handle cutouts 212, 213 and handle connecting portion 214, which is glued to panel 206, along the portion of panel 206 extending vertically above flap 205. In addition, there are main base panels 215, 217, 218 and 220 along with minor flaps 216 and 219 which are designed to be adhered to portions of panels 217, 220.

The various panels are marked by lines separating them from adjacent panels which may either be a clean cut, a scoring allowing folding inwardly about the line or a perforation which allows a reverse folding in the opposite or outward direction. Line 250, separating sections 201 and 214 is a cut with line 251 representing a score. Line 252 connecting panels 201 and 202 is a score. Line 253 is a score. Vertical line 254 is a perforation which allows a backward fold between panels 210 and 209. Line 255 is a cut. Line 256 is a cut. Line 257 is a score. Line 258 is a cut and line 259 is a perforation allowing backward folding. Line 260 is a score and line 261 is a cut. Lines 262 and 263 are score lines and line 264 is a cut. Line 265 is a perforation. Line 266 is a cut, line 267 is a score, line 268 is a perforation allowing bending backward and line 269 is a cut. Lines 271, 273, 274, 276 and 277 are all scores. Lines 272 and 275 are perforations.

In assembling the carrier 200, first panels 216 and 219 are glued or otherwise affixed to a corresponding portion of base panels 217 and 220, respectively. Next, panels 206 and 209 are overlapped so that openings 212 and 213 lay on top of each other and these panels are glued together both above and below the openings 212, 213. Then, flap 205 is secured to panel 201 and the portion of panel 206 extending vertically above 205 (in FIG. 4) is glued to panel 214 to create a shape substantially identical to the shape of panel 209. This then causes the carrier 200 to take on the flat shape shown in FIG. 5 and then with gentle pressure applied to the corners of the flattened carrier 200 the box snaps into assembly as shown in FIG. 6.

The conversion from a shipping and storage mode as shown in FIG. 5 to the fully opened form shown in FIG. 6 is accomplished easily and without any complicated assembly through the attachment of handle portions 206 and 209 which form the center of the carrier both in the flattened and opened states. The other components which form the dividers then rotate about this fixed central portion from the flat state of FIG. 5 to the opened condition shown in FIG. 6.

Other configurations and angles of lines may be utilized in connection with the design of carrier 200 such that different configurations of the divided spaces are accomplished. In each of these, the central portion around the handle openings 212, 213 are secured in place and act as a pivot or fulcrum about which the other elements move.

Other variations in accordance with these features may be utilized. Similar constructions with greater or fewer number of sections may also be formed utilizing the same principles and structures identified herein.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A multiple-compartment foldable carrier formed a single foldable blank comprising:

a) a pair of opposed side wall panels having attached thereto a bottom side portion having attached thereto a handle portion, said handle portion comprising a base having opposed inwardly extending first slots defining a pair of opposed extensions; and b) a pair of opposed end wall panels having attached thereto a bottom end portion having attached thereto a divider portion, said bottom end portion and divider portion together defining a second slot;

wherein said bottom end portions together define the base of the carrier, said divider portions extending perpendicular to the base and together with the bottom end portions defining opposed L-shaped second slots adapted to receive and secure therein the pair of opposed extensions of the handle portions.

2. The carrier of claim 1 further comprising additional base panels extending from the end wall panels to strengthen the base of the carrier.

3. The carrier of claim 1 comprising six separate volumes within the carrier.

4. The carrier of claim 3 wherein the six separate volumes are substantially equal in size.

5. A multi-unit foldable carrier formed from a single blank, comprising:

a pair of opposed sidewall panels having attached thereto a bottom side portion;

a pair of opposed end wall panels having attached thereto a bottom end portion, said bottom side portion and bottom end portions forming a base of the carrier;

longitudinally oriented divider means for dividing the interior space of the carrier into two generally equal volumes formed from at least two panels secured to each other, the longitudinally oriented divider means also including an opening formed therein which acts as a handle;

transversely oriented divider means for further dividing each of the volumes of space into at least two smaller volumes of space, coupled between the sidewall panels and the longitudinally oriented divider means.

6. The carrier of claim 5 wherein the longitudinally oriented divider means is formed of three overlapping panels.

7. The carrier of claim 6 wherein the handle is formed of an opening in the middle panel of the longitudinally oriented divider means.

8. The carrier of claim 5 wherein the transversely oriented divider means divides each of the two volumes into three smaller volumes.

9. The carrier of claim 5 wherein the transversely oriented divider means is generally perpendicular in an assembled state to each of the longitudinally oriented divider means and the sidewall panels and generally parallel in a folded state to each of the longitudinally oriented divider means and the sidewall panels.

10. The carrier of claim 5 wherein the carrier is reversibly movable from a folded state to an assembled state, wherein the carrier is generally flat in the folded state and a generally rectangular solid in its assembled state.

* * * * *